US008584846B2

(12) United States Patent
Whalen et al.

(10) Patent No.: US 8,584,846 B2
(45) Date of Patent: Nov. 19, 2013

(54) BOW CASE

(75) Inventors: John Whalen, Sheridan, IL (US); John Hagemann, Plano, IL (US); Joseph F. Fiore, Lebanon, PA (US)

(73) Assignee: Plano Molding Company, Plano, IL (US)

( * ) Notice: Subject to any disclaimer, the term of this patent is extended or adjusted under 35 U.S.C. 154(b) by 0 days.

(21) Appl. No.: 13/533,773

(22) Filed: Jun. 26, 2012

(65) Prior Publication Data

US 2013/0001115 A1 Jan. 3, 2013

Related U.S. Application Data

(60) Provisional application No. 61/503,218, filed on Jun. 30, 2011.

(51) Int. Cl.
*B65D 85/00* (2006.01)
*B65D 51/18* (2006.01)

(52) U.S. Cl.
USPC ..... 206/315.11; 206/315.1; 206/317; 220/254.3; 220/254.6; 220/720

(58) Field of Classification Search
USPC ..... 206/315.1, 315.11, 317; 220/254.3, 220/254.6, 720
See application file for complete search history.

(56) References Cited

U.S. PATENT DOCUMENTS

| | | | | |
|---|---|---|---|---|
| D182,868 | S * | 5/1958 | Arnold | D3/289 |
| 4,480,774 | A * | 11/1984 | Smith et al. | 224/610 |
| 5,450,956 | A * | 9/1995 | Peckenpaugh et al. | 206/315.11 |
| 6,571,946 | B2 * | 6/2003 | Fiore, Jr. | 206/315.11 |
| 6,793,074 | B2 * | 9/2004 | Anderson et al. | 206/349 |
| 6,935,495 | B1 * | 8/2005 | Mc Kenzie | 206/315.11 |
| 7,032,749 | B2 * | 4/2006 | Hochstetler et al. | 206/349 |
| 7,104,402 | B2 * | 9/2006 | Whalen et al. | 206/579 |
| 2002/0130057 | A1 * | 9/2002 | Salyers | 206/315.11 |
| 2003/0221982 | A1 * | 12/2003 | Cook et al. | 206/315.11 |
| 2006/0042897 | A1 * | 3/2006 | Sanderson | 190/120 |

* cited by examiner

*Primary Examiner* — Steven A. Reynolds
*Assistant Examiner* — Javier A Pagan
(74) *Attorney, Agent, or Firm* — McGuireWoods LLP

(57) ABSTRACT

A bow case is described that is flexibly configurable to accommodate bows such as crossbows including recurve crossbows, compound crossbows, pistol crossbows, or the like, which may have different configurations such as different shapes, lengths, widths, depths, heights, weights or the like. A bow case having an adjustable tail portion is provided that may be configurable to different lengths.

23 Claims, 12 Drawing Sheets

BOW CASE

CROSS-REFERENCE TO RELATED APPLICATIONS

This application claims benefit and priority to U.S. Provisional Patent Application No. 61/503,218, filed Jun. 30, 2011, entitled BOW CASE, the disclosure of which is hereby incorporated herein by reference in its entirety.

BACKGROUND OF THE DISCLOSURE

1. Field of the Disclosure

This disclosure is directed to a bow case, and more particularly, to a bow case for storing and carrying various crossbows and accessories.

2. Related Art

Crossbows exist in many variants. Even within the same variant, crossbows are available in different configurations, e.g., weight, shape, length, width, height. Thus, often a case suitable for storing one crossbow may not necessarily be suitable for another. Moreover, adequate protection and ease of transportation are often a significant issue for crossbow owners. Accordingly, there is a need for a case for storing crossbows of different variants and configurations.

SUMMARY OF THE DISCLOSURE

The present disclosure meets the foregoing needs and provides for a bow case that may be configurable to different sizes thereby permitting storage of crossbows of different configurations, such as, e.g., weight, shape, length, width, height.

In one aspect, a bow case is provided including a main body portion comprising a lower body portion having a bottom wall and a sidewall surrounding the bottom wall and an upper body portion pivotally connected to a front portion of the lower body portion to move between an open position and a closed position, a tail portion connected to a rear portion of the main body portion and comprising: a lower tail portion connected to the lower body portion, and an upper tail portion pivotally connected to a rear portion of the lower tail portion to move between the open position and the closed position and a storage space substantially encapsulated by the main body portion and the tail portion when the upper body portion and the upper tail portion are in the closed position, wherein a length of the tail portion protruding from the main body portion is adjustable.

In one aspect, a main body portion is provided that includes a lower body portion having a bottom wall and a sidewall surrounding the bottom wall and an upper body portion pivotally connected to a front portion of the lower body portion to move between an open position and a closed position, a tail portion connected to a rear portion of the main body portion and comprising: a lower tail portion connected to the lower body portion and an upper tail portion pivotally connected to a rear portion of the lower tail portion to move between the open position and the closed position, and a storage space substantially encapsulated by the main body portion and the tail portion when the upper body portion and the upper tail portion are in the closed position, wherein the tail portion is configured to move with respect to the main body portion in order to adjust the length of the bow case to accommodate bows of different sizes.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

DETAILED DESCRIPTION OF THE DISCLOSURE

Figure 1:
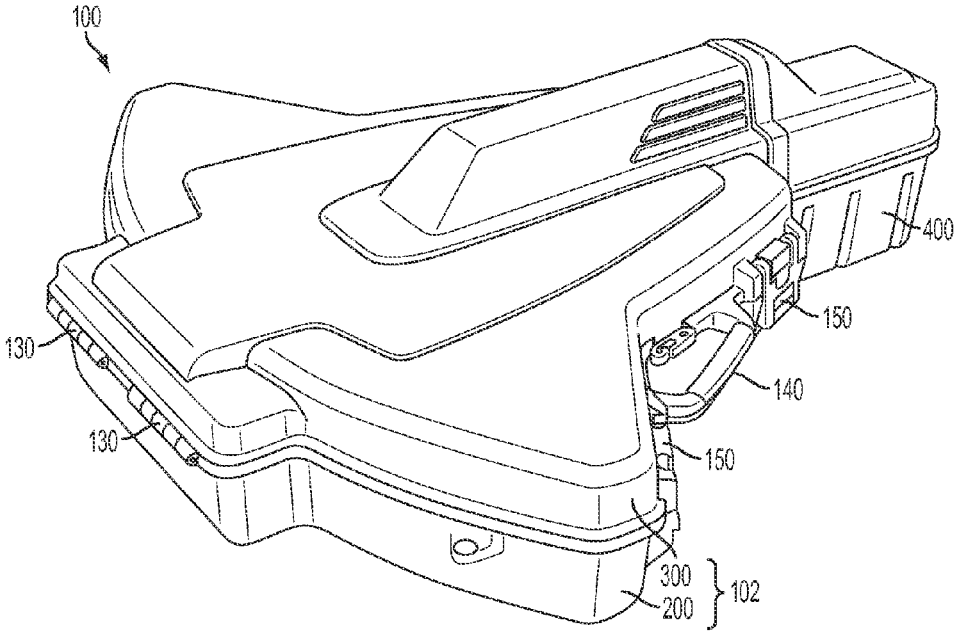
FIG. 1 shows a perspective view of a bow case in a closed position, constructed according to the principles of the disclosure.

The examples of the disclosure and the various features and advantageous details thereof are explained more fully with reference to the non-limiting examples that are described and/or illustrated in the accompanying drawings and detailed in the following description. It should be noted that the features illustrated in the drawings are not necessarily drawn to scale, and features of one example may be employed with other examples as the skilled artisan would recognize, even if not explicitly stated herein. Descriptions of well-known components and processing techniques may be omitted so as to not unnecessarily obscure the various aspects of the disclosure. The examples used herein are intended merely to facilitate an understanding of ways in which the disclosure may be practiced and to further enable those of skill in the art to practice the principles of the disclosure. Accordingly, the examples herein should not be construed as limiting the scope of the disclosure, which is defined solely by the appended claims and applicable law. Moreover, it is noted that like reference numerals represent similar parts throughout the several views of the drawings.

FIG. 1 shows a perspective view of a bow case 100 in a closed position, constructed according to the principles of the disclosure. The bow case 100 may be configured to store crossbows of different variants (e.g., recurve crossbows, compound crossbows, pistol crossbows or the like) and/or different configurations (e.g., shapes, lengths, widths, depths, heights, weights and/or the like).

Figure 7:
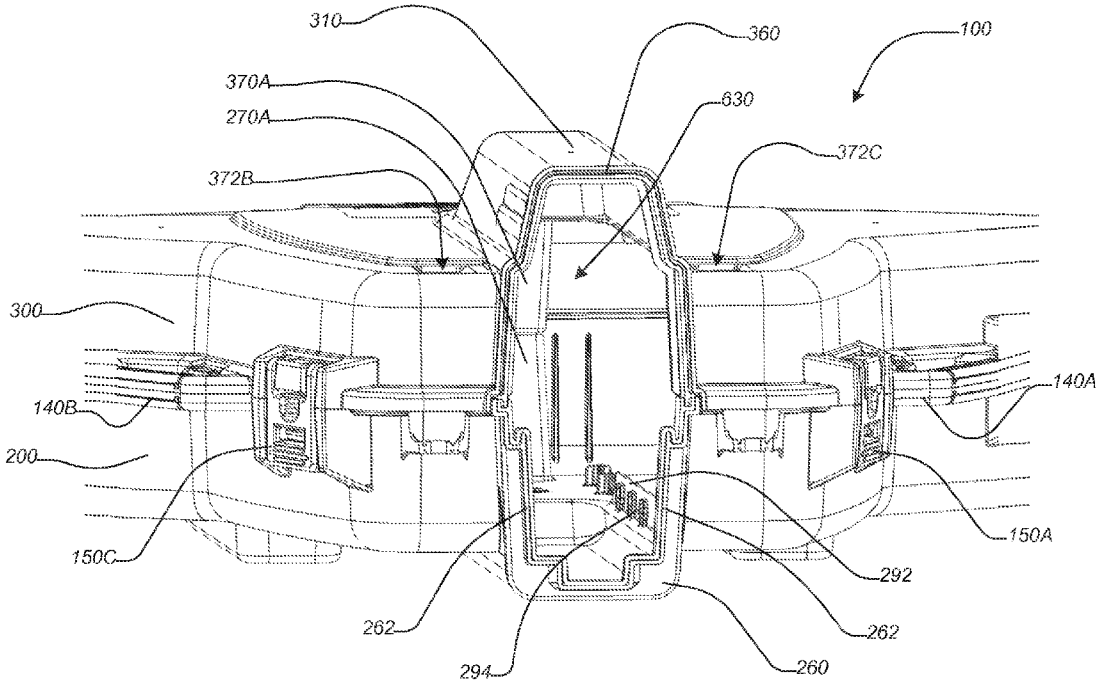
FIG. 7 shows a partially enlarged perspective rear view of the bow case of FIG. 1 with a tail portion removed.

The bow case 100 may comprise a lower body portion 200, an upper body portion 300, a tail portion 400, which may be manufactured individually and assembled together to form the bow case 100. A combination of the lower body portion 200 and the upper body portion 300 may constitute a main body portion 102. The tail portion 400 may be disconnected from the main body portion 102 (as shown in FIG. 7). After being disconnected and/or replaceably removed from the main body portion 102, the tail portion 400 may be inserted into the main body portion 102 such as for storage or collapsibility (shown in FIG. 8). The bow case 100 may further include one or more hinges 130, one or more handles 140, one or more locking units 150 (i.e., 150A, 150B, 150C, 150D), and/or the like.

Figure 2:
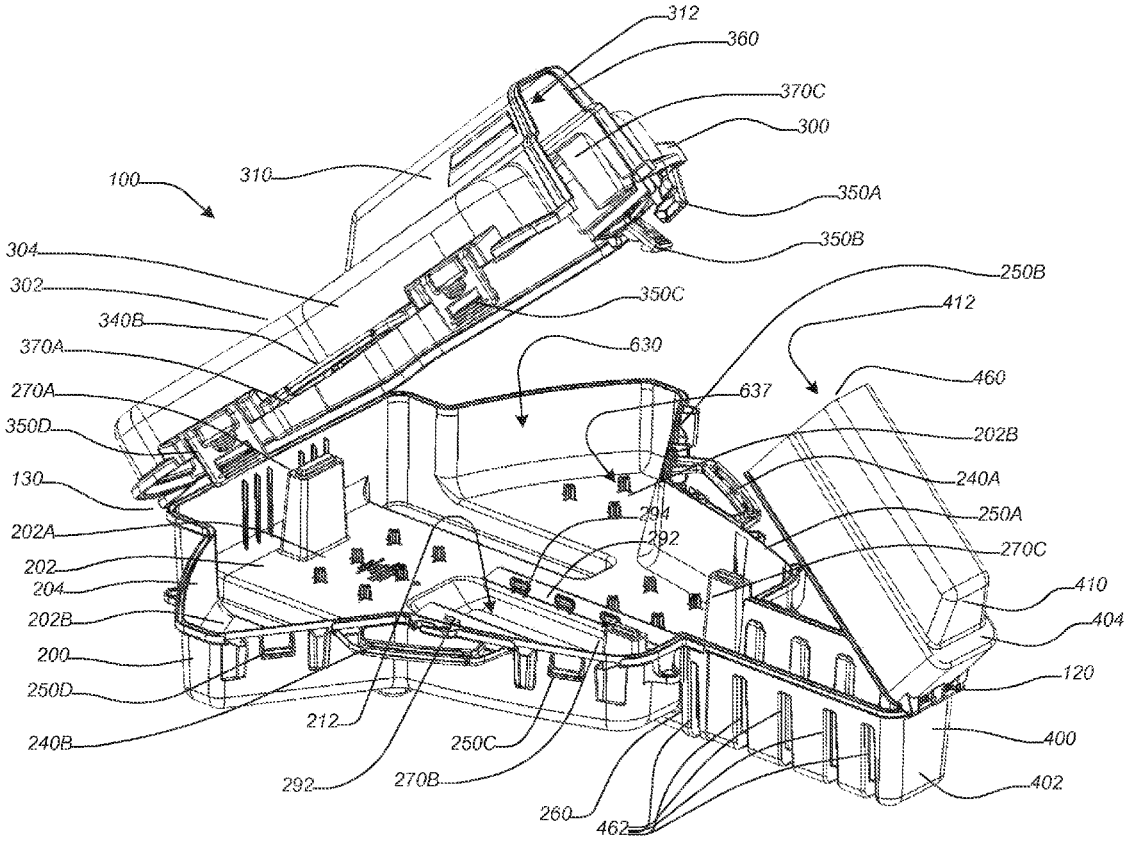
FIG. 2 shows a perspective view of the bow case of FIG. 1 in an open position.
Figure 4:
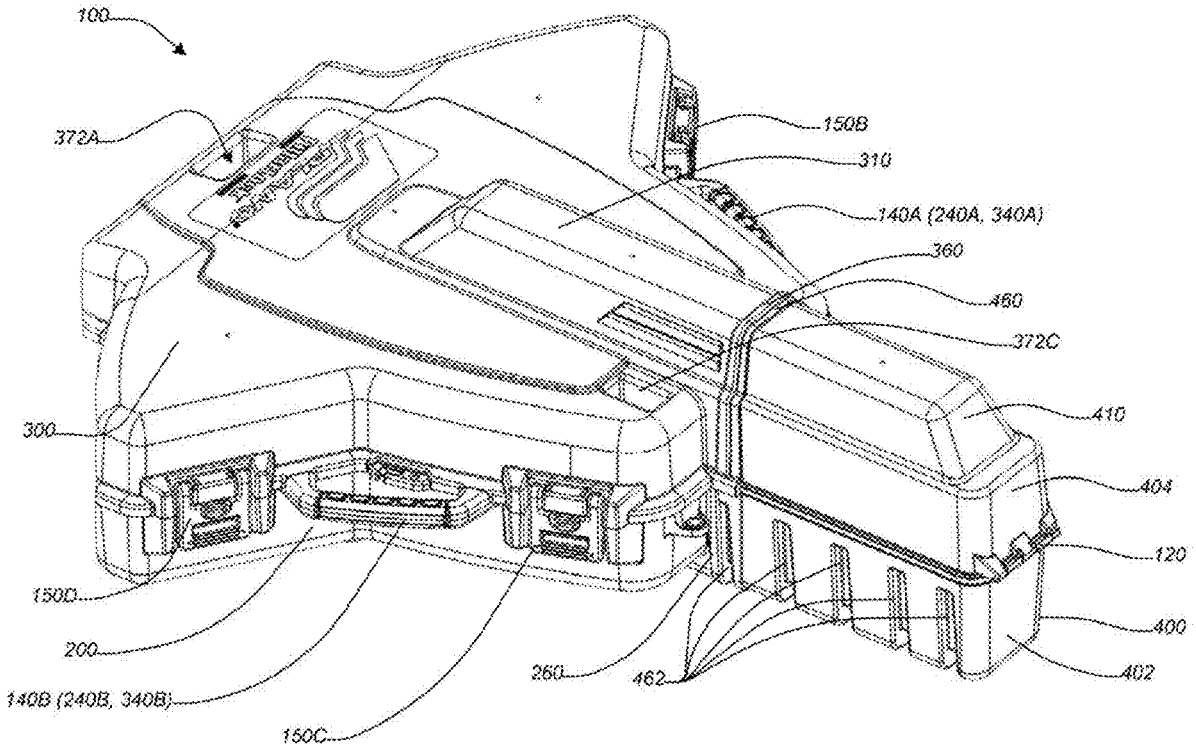
FIG. 4 shows another perspective view of the bow case of FIG. 1 in the closed position.

FIG. 2 shows a perspective view of the bow case 100 in an open position, and FIG. 4 shows another perspective view of the bow case in the closed position. Referring to FIGS. 2 and 4 concurrently, the lower body portion 200 and the upper body portion 300 may be pivotally connected to each other by, e.g., one or more hinges 130 or the like, such that the upper body portion 300 may move between the open position (shown in FIG. 2) and the closed position (shown in FIG. 4). As seen in FIG. 1, two hinges 130 may be located at the front end portion of the main body portion 102. More or fewer hinges 130 may be used and located at other locations of the main body portion 102. In addition to, or instead of the hinge(s) 130, other pivotal or non-pivotal connections may be used for the connection between the lower body portion 200 and the upper body portion 300, such as, for example, one or more straps (not shown) that are affixed to both the upper and lower body portions 300, 200, male-female couplings (not shown) that are provided on the upper and lower body portions 300, 200, additional lock units 150, or the like.

When the bow case 100 is in the closed position, the lower body portion 200, the upper body portion 300 and the tail portion 400 may substantially completely encapsulate a storage space 630 for a bow 500, such as, e.g., bows 500A, 500B, 500C and 500D (such as shown in FIGS. 9A, 9B, 9C and 9D). When the bow case 100 is in the closed position, the lower body portion 200 may constitute a bottom portion of the main body portion 102 and the upper body portion 300 may constitute a top portion of the main body portion 102.

Referring to FIG. 2, the lower body portion 200 may include a bottom wall 202 and a sidewall 204. The sidewall 204 may extend along the edge of the bottom wall 202. Similarly, the upper body portion 300 may include a top wall 302 and a sidewall 304. The sidewall 304 may extend along the edge of the top wall 302. The bottom wall 202 and the top wall 302 may have substantially the same horizontal shape. For example, the bottom wall 202 and the top wall 302 may have a stingray shape. Further, the bottom wall 202 and the top wall may be configured to have planar surfaces that are substantially parallel to each other. The sidewall 204 of the lower body portion 200 may be taller than the sidewall 304 of the upper body portion 300. Alternatively, the sidewall 204 of the lower body portion 200 may be shorter than, or substantially the same height as the sidewall 304. The bottom wall 202 may be divided into a body portion 202A and a pair of wing portions 202B located at both sides of the body portion 202A. The top wall 302 may also be divided in a similar manner.

Figure 5:
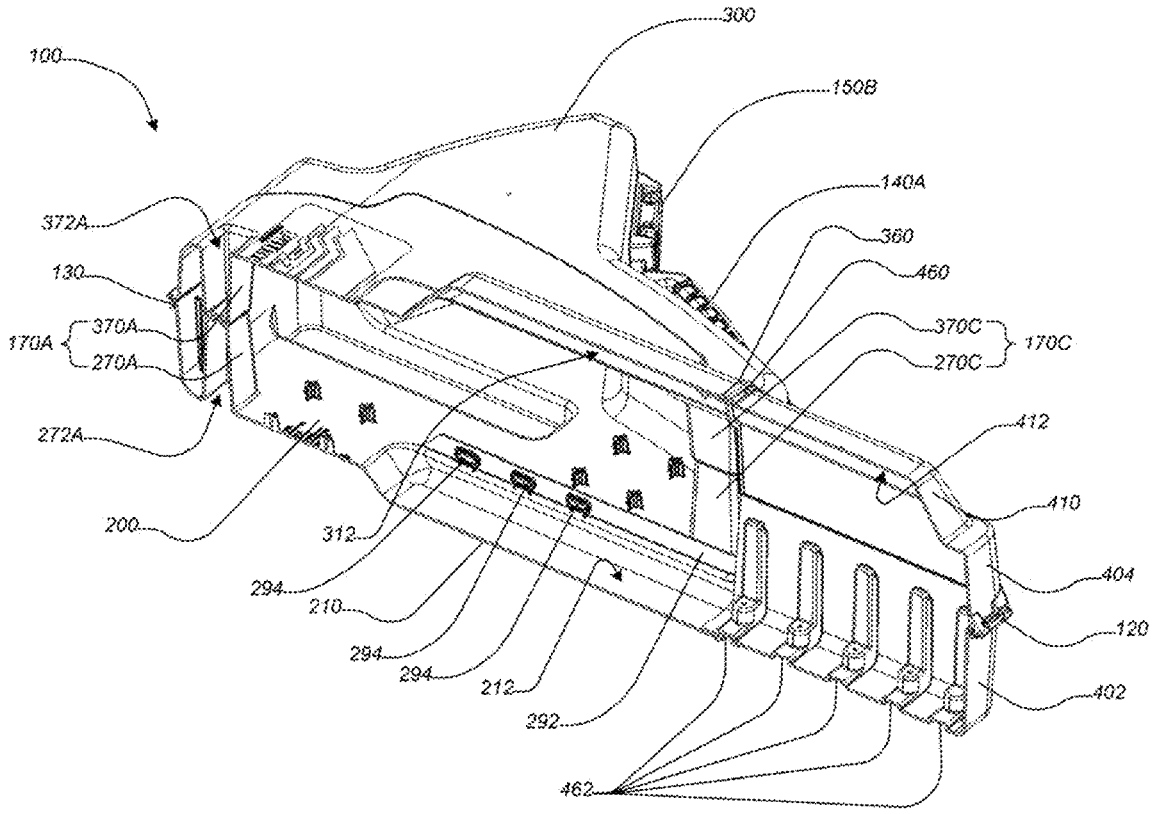
FIG. 5 shows a perspective cross-sectional view of the bow case of FIG. 1.

The bottom wall 202 may include a well 212 on an interior surface thereof. The well 212 may extend from a center portion to a rear end portion of the body portion 202A of the bottom wall 202, as shown in FIG. 5. The well 212 may include a space formed by a protrusion 210 formed in the bottom wall 202 of the lower body portion 200. The upper body portion 300 may include a well 312 on an interior surface thereof, which may extend in parallel to the well 212 of the lower body portion 200. The well 312 may include a space formed by a protrusion 310 formed in of the top wall 302 of the upper body portion 300. The well 312 may be deeper than the well 212. Alternatively, the well 212 may be deeper, or have substantially the same depth as the well 312.

The tail portion 400 may include a lower tail portion 402, an upper tail portion 404. The upper tail portion 404 may be pivotally connected to the lower tail portion 402 by, for example, a hinge 120, and/or the like, to move between the closed position (shown in FIG. 4) and the open position (shown in FIG. 2). Alternatively, the lower body portion 200 and the lower tail portion 402 may be constructed as a single unit, to which the upper body portions 300 and the upper tail portion 404 are pivotally attached. The hinge 120 may be located at a rear end portion of the tail portion 400. Additional (e.g., more than one) hinges 120 may be used and located at different portions of the tail portion 400. Other pivotal or non-pivotal connections are also contemplated for the connection therebetween, such as, for example, one or more straps (not shown) that are affixed to both the upper and lower tail portions 404, 402, male-female couplings (not shown) that are provided on the upper and lower tail portions 404, 402, additional lock units 150, or the like.

The upper tail portion 404 may include a well 412, which may be formed by an interior surface of a wall of the top tail portion 404. The well 412 may include a protrusion 410 formed on an exterior surface of the top of the upper tail portion 404. The wells 312 and 412 may be connected to each other when the bow case 100 is in the closed position. The wells 212, 312 and 412 may provide additional storage space for vertically extending elements of the bow 500, such as, e.g., a handle, a telescope, a trigger and/or the like.

Figure 9A:
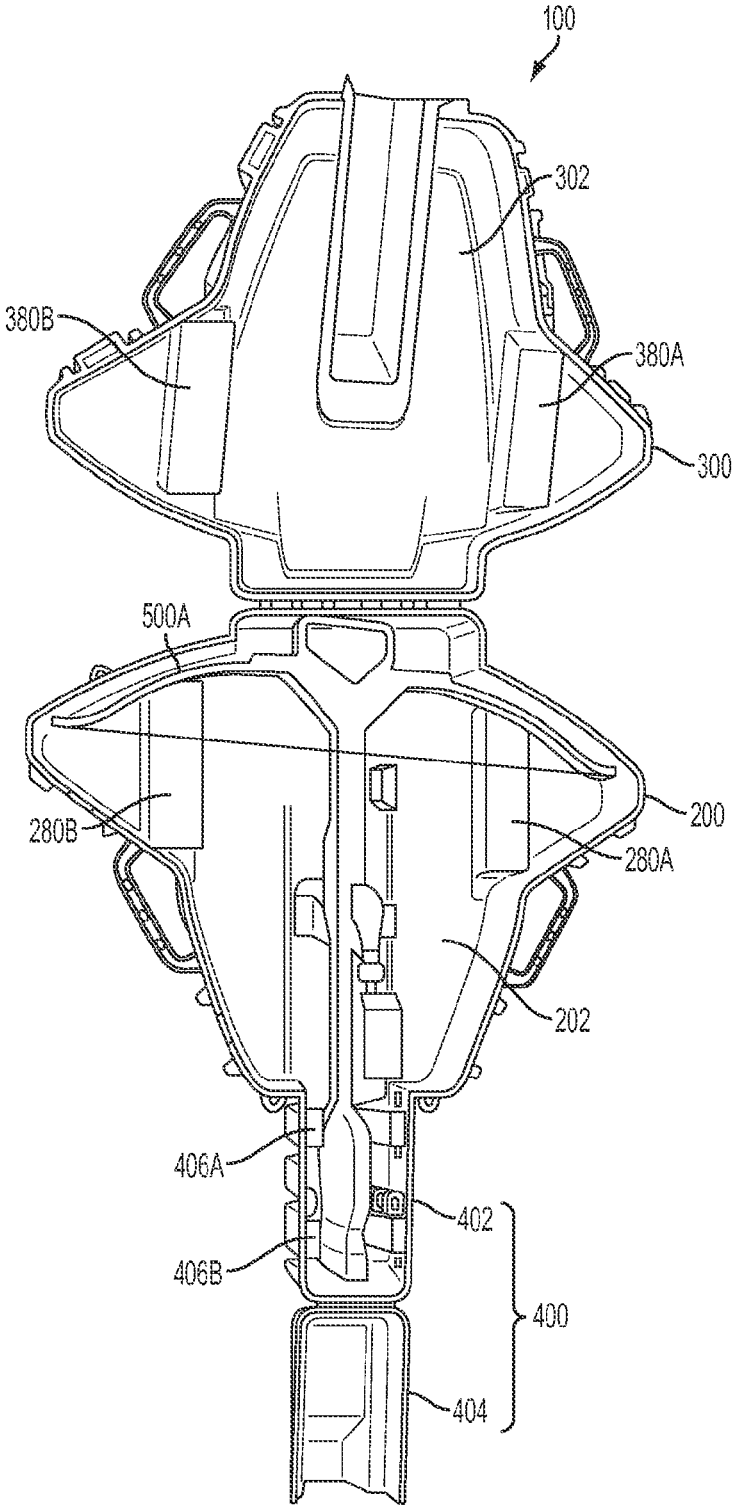
FIGS. 9A, 9B, 9C and 9D show the bow case of FIG. 1 storing crossbows of different variants, respectively.
Figure 9B:
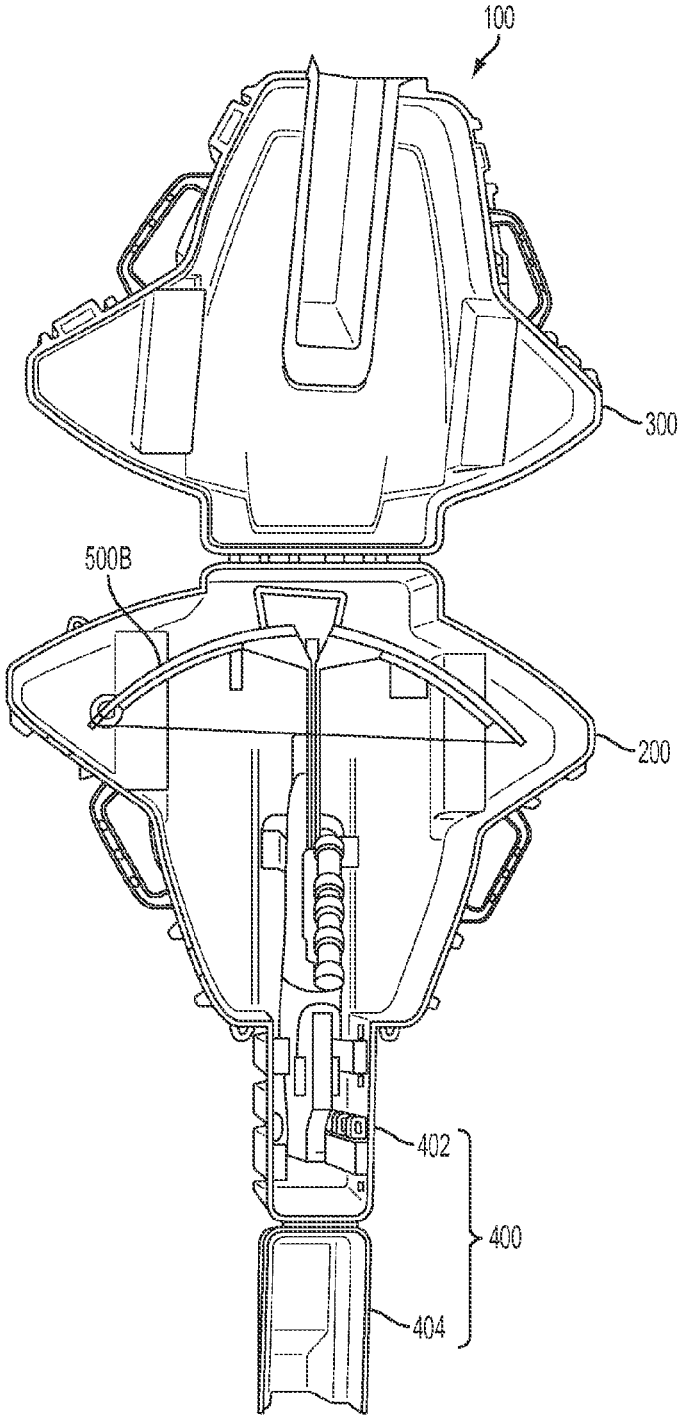
Figure 9C:
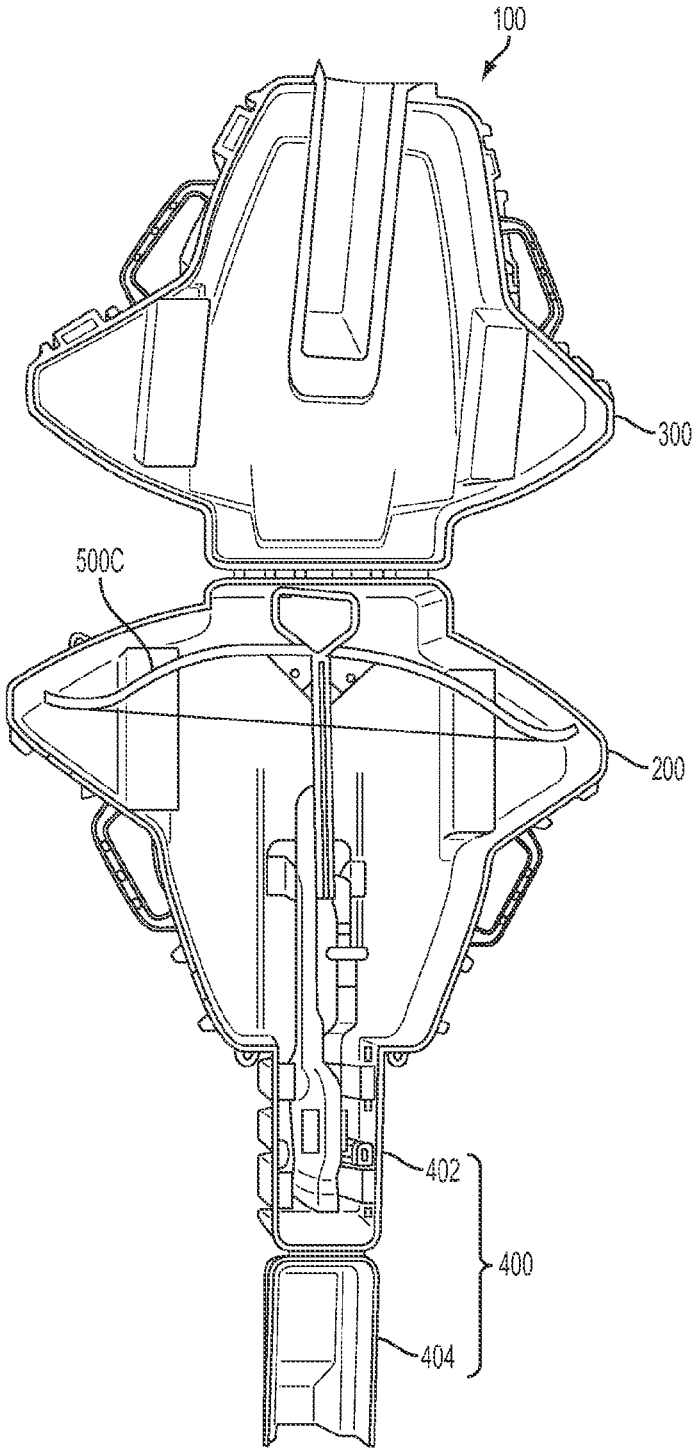
Figure 9D:
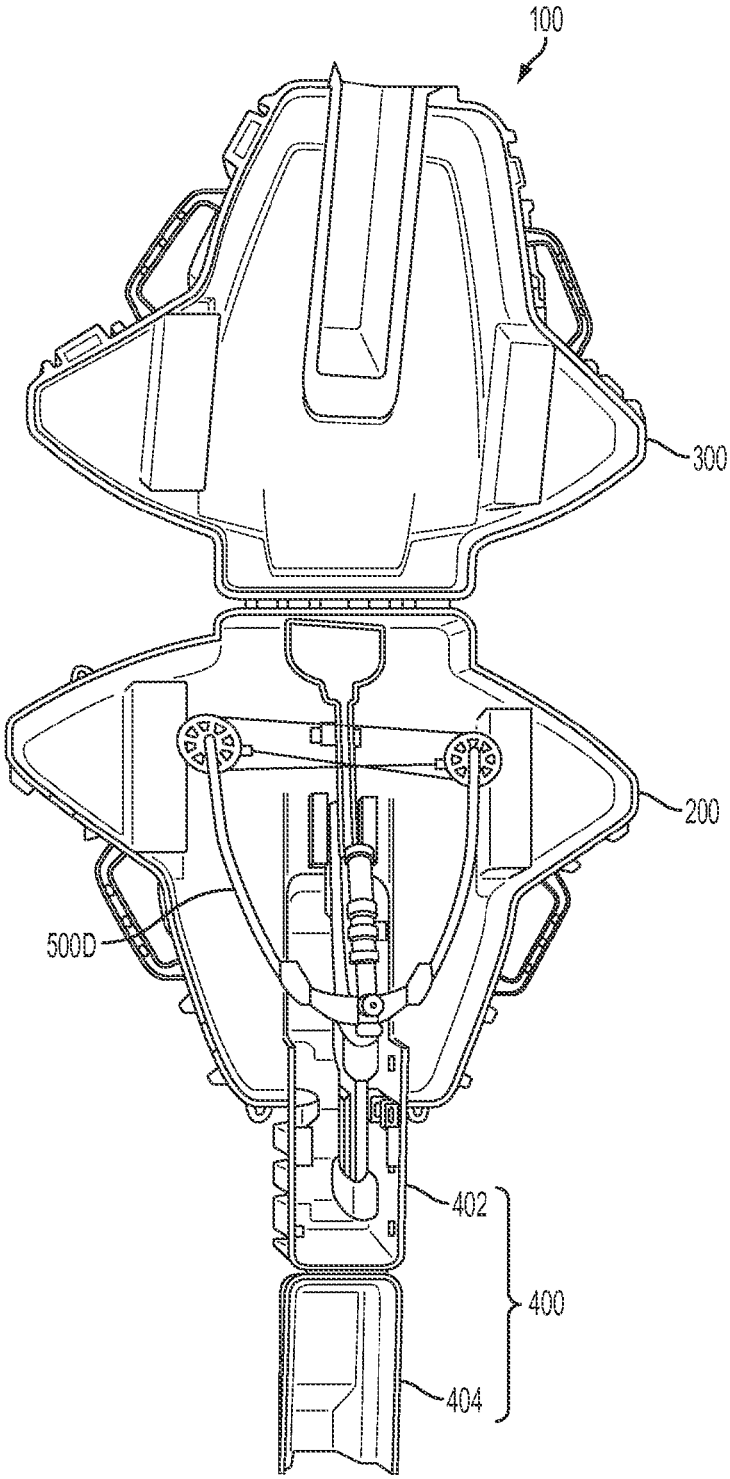

The bow case 100 may further comprise one or more stabilizing elements, such as, e.g., a foam limb, a foam insert and/or the like, for stabilizing the bow 500 when the bow case 100 is closed. For example, as shown in FIG. 9A, a pair of foam limb stabilizers 280A and 280B may be attached to or placed atop of the bottom wall 202 of the lower body portion 200. Additionally, another pair of foam limb stabilizers 380A and 380B may be attached to or placed against an inner surface of the top wall 302 of the upper body portion 300. When the bow case 100 is closed, the bow 500A may be sandwiched between the stabilizer pair 280A and 280B and the stabilizer pair 380A and 380B, which may prevent the bow 500A from moving within the case 100 once the case 100 is closed.

Figure 3:
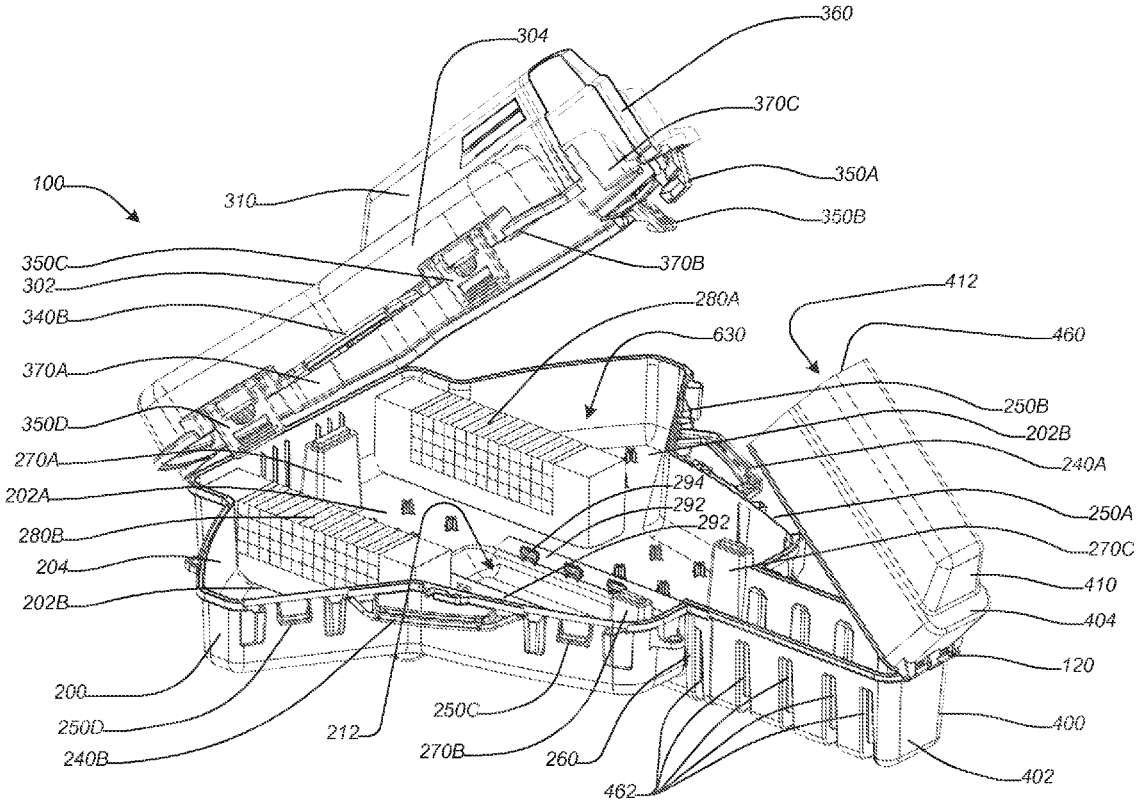
FIG. 3 shows another perspective view of the bow case of FIG. 1 in the open position with stabilizing elements.

The stabilizing elements 280A, 280B, 380A, 380B may be configured to allow a user to shape the elements to fit a bow that is to be stored in the bow case 100. For example, as shown in FIG. 3, a portion of the foam limb stabilizers 280A and 280B may be incompletely cut to form a matrix of cuboid foam pieces that are loosely connected to each other. The user may remove one or more foam pieces to shape the foam limb stabilizers 280A and 280B, as necessary. Each foam piece may be easily disconnected from the surrounding foam pieces such as by pulling the foam piece gently away from the surrounding foam pieces. The foam limb stabilizers 380A and 380B may be configured similar to the foam stabilizers 280A and 280B.

Figure 6:
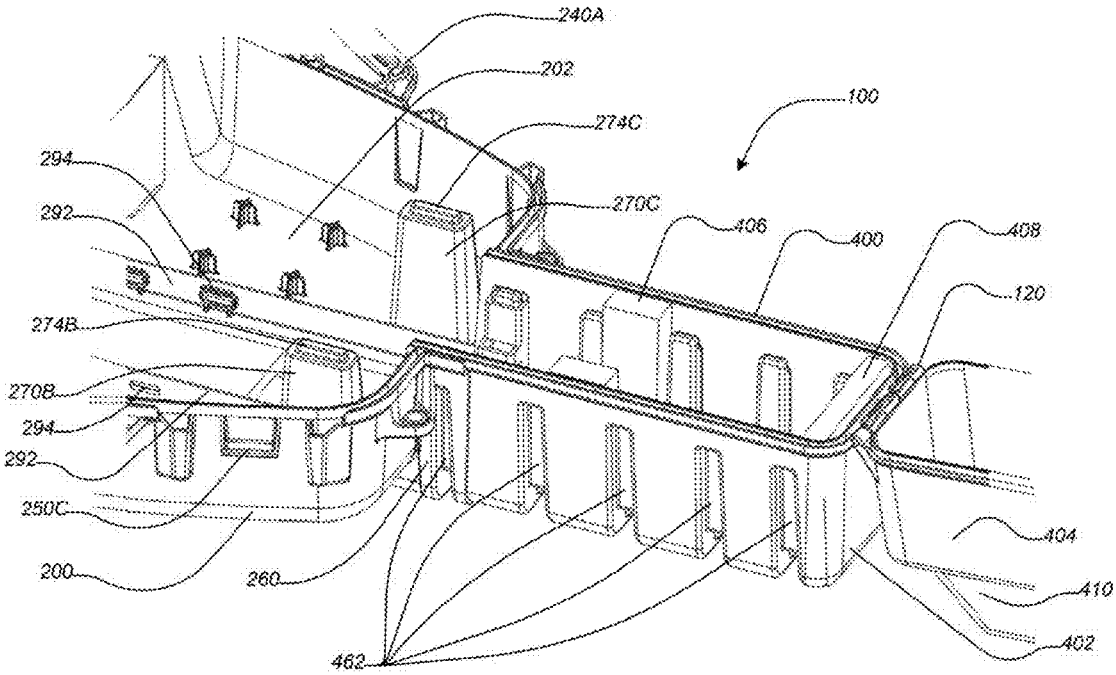
FIG. 6 shows a partially enlarged perspective view of the bow case of FIG. 1.

The bow case 100 may further include one or more additional stabilizing elements. For example, as shown in FIG. 6, a foam insert 406 may be attached to, wedged between a plurality of ribs, or otherwise placed against the bottom wall and opposed side walls of the lower tail portion 402 (as seen in FIG. 6) to stabilize the handle portion of the bow 500 in the tail portion 400. The foam insert 406 may have a U shape to surround the sides and bottom of the handle portion of the bow 500. The foam insert 406 may be formed to fit into the bottom and side surfaces of the lower tail portion 402. More than one foam insert 406 may be used. For example, as seen in FIG. 9A, two foam inserts 406A and 406B may be attached to or placed in the lower tail portion 402. In FIG. 6, another foam insert 408 may be attached to or placed in a rear wall portion of the lower tail portion 402. Additional (or fewer) stabilizing members (or elements) may be attached to or placed in different portions of the bow case 100. For example, another foam insert (not shown) may be attached to or placed in the well 312, or the like. The stabilizing elements 406, 408 may prevent the bow 500A from moving within the bow case 100 when the bow case 100 is closed. The stabilizing elements 280A, 280B, 380A, 380B, 406, 408 may keep the bow 500A safely away from the interior surfaces of the lower body portion 200, the upper body portion 300 and the tail portion 400 such that an impact to the bow case 100 may not be directly transferred to the bow 500A.

Additionally or alternatively, the stabilizing elements 280A, 280B, 380A, 380B, 406, and/or 408 may include one or more retention straps (not shown) and/or the like to hold the bow 500 in a secured position. For example, a pair of retention straps (not shown) may be connected to and extend from a bottom wall and/or lower sidewalls of the lower tail portion 402. The retention straps may be made of plastic, synthetic fabric (e.g., polyester, nylon and/or the like) and/or the like. Other natural and/or synthetic materials are also contemplated. Also, the lengths of the retention strap pair may be adjustable.

The retention strap pair may include a fastener, such as, e.g., a hook-and-loop fastener, a snap fastener, a buckle and/or the like. For example, one of the retention strap pair may include a female hook-and-loop fastener and the other one may include a male hook-and-loop fastener. When one of the retention strap pair travels over the top of the bow 500A and is fastened to the other of the retention strap pair, the handle portion of the bow 500A may be pushed downwardly by the retention strap pair and kept secured against and surrounded by the foam insert 406. Additional retention strap pairs may be used in the tail portion 400.

The main body portion 102 may also include one or more retention strap pairs (not shown). The retention strap pairs may be connected to the lower body portion 200. For example, as seen in FIG. 2, the lower body portion 200 may include a pair of rails 292, which may be configured to extend along both sides of the well 202. Each of the rails 292 may include a plurality of holes 294 that are spaced apart from each other. Alternatively, the rails 292 may include fastening mechanisms (not shown), each of which may be configured to attach to an end of one of the straps of the retention strap pair. The holes 294 may be used to connect one or more retention strap pairs to the lower body portion 200 at desired locations. Each hole 294 may be shaped to allow the retention strap to pass therethrough. The retention strap may have a stop (not shown), such as, e.g., a D-ring or the like, at one end thereof, which may be larger than the hole 294. The other end of the strap may include a fastener. When the other end of the retention strap is inserted into the hole 294 and pulled by the user, the D-ring may contact the rail 292 and stop the retention strap from fully escaping through the hole 294. Portions of the rails 292 surrounding the holes 294 may be reinforced and/or shaped to engage the D-ring such that the D-ring may stay attached to the rail 292 once the strap is connected to the rail 292. Another retention strap may also be connected to the opposite rail 292 in a similar manner. The two straps from the opposite rails 292 may form the retention strap pair mentioned above, thereby further securing the bow 500A in the main body portion 102.

The bow case 100 may be configured such that a length of the tail portion 400 protruding from the rear end of the main body portion 102 may be adjusted. For example, in FIG. 2, the lower tail portion 402 may include a plurality of grooves 462. The grooves 462 may have substantially the same size and shape. The grooves 462 may be arranged to be substantially in parallel with a gap between two neighboring grooves 462. The grooves 462 may have a U shape that extends from one side of the lower tail portion 402 to the opposite side via the bottom surface as seen in FIG. 5. Each groove 462 may be configured to engage a rear edge (or tongue) portion 260 of the lower body portion 200. For example, as seen in FIG. 7, the rear edge portion 260 may include a protrusion pattern 262 configured to fit in and mate with the grooves 462. A weather (or sealer) stripping (not shown) may be attached to the protrusion pattern 262 to seal the gap between the lower body portion 200 and the lower tail portion 404 when they are connected to each other.

Figure 8:
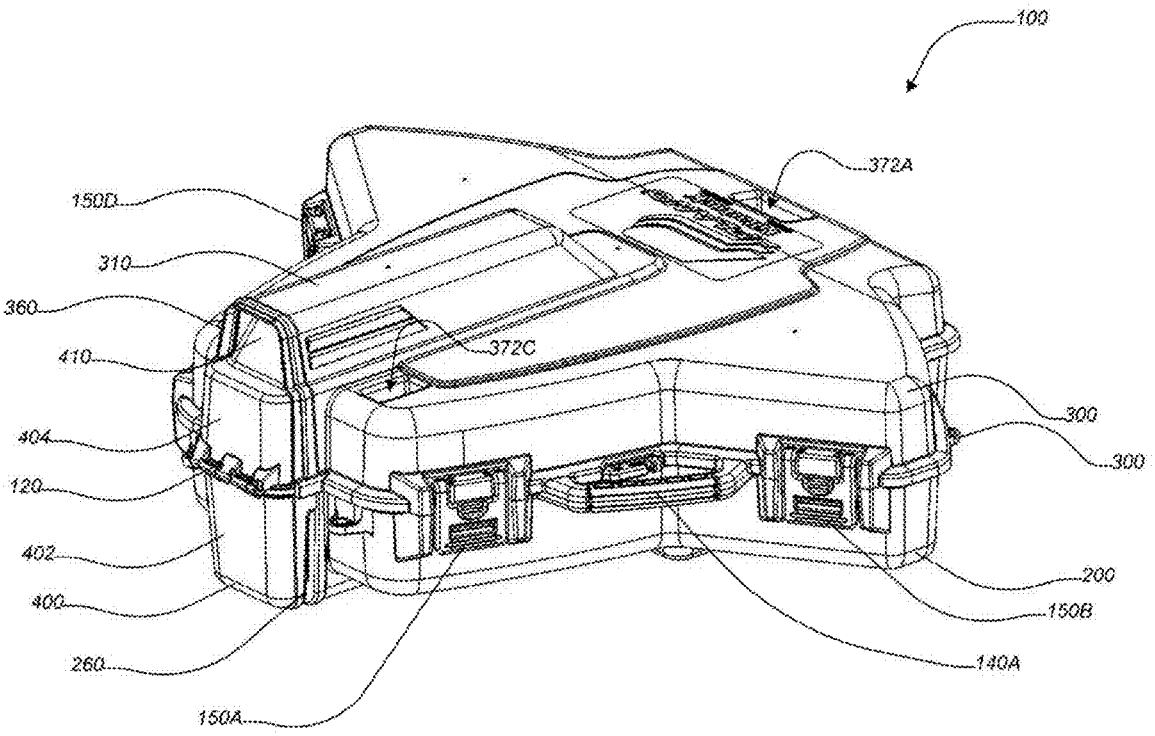
FIG. 8 shows a perspective view of the bow case of FIG. 1 with the tail portion inserted into a main body portion.

The user may adjust the length of the tail portion 400 protruding from the rear edge portion 260 by engaging the protrusion pattern 262 (FIG. 7) with one of the grooves 462. For example, in order to store a very short bow that requires little or none of the storage space provided by the tail portion 400, the user may engage the protrusion pattern 262 of the lower body portion 200 to the groove 462 closest to the rear end wall of the lower tail portion 402, as seen in FIG. 8. For a longer bow that requires the entire storage space provided by the tail portion 400, the protrusion pattern 262 of the lower body portion 200 may be engaged to the groove 462 furthest from the rear end wall of the lower tail portion 402, as seen in FIG. 2. Further, the protrusion 410 of the upper tail portion 404 may have substantially the same cross-sectional shape with but slightly smaller than the protrusion 310 of the upper body portion 300 such that the lower body portion 200 and the upper body portion 300 may be shut completely regardless of how the tail portion 400 is connected to the lower body portion 200.

The protrusion pattern 262 and each groove 462 may have one or more holes that are aligned together when the protrusion pattern 262 is engaged to one of the grooves 462. A bolt (not shown) may be inserted into the aligned holes of the protrusion pattern 262 and the groove 462 and a nut (not shown) may engage the bolt to fasten the lower body portion 200 and the lower tail portion 402 together. Other fastening methods and fasteners are also contemplated, such as, for example, a pin, a clamp, a hook-and-loop, an adhesive, a spring-actuated push-button (as found on, e.g., umbrella release mechanisms), and the like. The holes of the grooves 462 that are not aligned with the holes of the protrusion pattern 262 may be used to fix the retention straps or other stabilizing elements.

Referring to FIGS. 4 and 5, a rear edge portion 360 of the upper body portion 300 and a front edge portion 460 of the upper tail portion 404 may be configured to overlap each other when they are closed. For example, the rear edge portion 360 of the upper body portion 300 may cover the front edge portion 460 of the upper tail portion 404. The upper body portion 300 may include weather (or sealer) stripping (not shown) that may extend along the rear edge portion 360 to seal the gap between the rear edge portion 360 and the front edge portion 460.

Referring to FIG. 4, the bow case 100 may include one or more handles 140, such as, e.g., handles 140A, 140B, which may be formed at both sides of the bow case 100 such that a user may carry the bow case 100 on his or her left or right side. Each handle 140 may be connected to either the lower body portion 200 or the upper body portion 300, or both. For example, as seen in FIG. 2, the lower body portion 200 may include first handle portions 240A and 240B connected to both sides thereof, respectively. The upper body portion 300 may include second handle portions 340A and 340B connected to both sides thereof, respectively. The first handle portion 240A and the second handle portion 340A may be aligned together when the main body portion 102 is in the closed position to form the handle 140A at one side of the bow case 100. Similarly, when the upper body portion 300 is closed, the first handle portion 240B and the second handle portion 340B may be aligned together to form the handle 140B at the other side of the bow case 100.

The bow case 100 may further include one or more locking fasteners 150, to keep the upper body portion 300 and tail portion 400 in the closed position. For example, in FIG. 2, the lower body portion 200 may include a plurality of latches 250A, 250B, 250C and 250D attached on both sides thereof. A plurality of latch keepers 350A, 350B, 350C and 350D may be formed on the upper body portion 300 such that they are aligned with the latches 250A, 250B, 250C, 250D, respectively, when the upper body portion 300 is closed. Other types of fasteners are also contemplated, such as, for example, loop and latch fasteners configured to receive a padlock, hole and spring-actuated push-button fasteners, hook-and-loop fasteners, flexible strap fasteners, and the like. Additionally, the bow case 100 may include a locking unit (not shown). When the rear edge portion 360 of the upper body portion 300 covers or engages the front edge portion 460 of the tail portion 400, no fasteners may be necessary to keep the upper body portion 300 closed. Alternatively, the tail portion 400 may include one or more fasteners to keep the tail portion 400 closed independently.

Referring to FIG. 5, the bow case 100 may further include one or more pillars 170 (i.e., 170A, 170B, 170C) to reinforce the construction strength of the bow case 100. For example, in FIG. 2, the lower body portion 200 may include protrusions 270A, 270B and 270C extending upwardly from the interior surface thereof. The upper body portion 300 may include protrusions 370A, 370B and 370C extending downwardly from the interior surface thereof. The protrusions 370A, 370B and 370C may be arranged to overlap and engage the protrusions 270A, 270B and 270C, respectively, when the bow case 100 is closed. Each pillar 170 may be formed when a pair of corresponding protrusions 270, 370 is connected to each other.

Alternatively, each pillar 170 may include only a single protrusion 270 (or 370) that is configured to extend and contact the inner surface of the top wall 302 (or bottom wall 202). The protrusions 370 and/or 270 may be integrally formed with the upper and/or lower body portions 300, 200, respectively. Alternatively, the protrusions 370 and/or 270 may be configured to be movable to accommodate differently shaped bows.

Further, the inner surface of the top wall 302 and/or the inner surface of the bottom wall 202 may be provided with a plurality of adjusting male protrusions 637. The adjusting male protrusions 637 may each have a cross-section that is formed in, for example, the shape of a hexagon, a square, a triangle, a cross, a circle, or the like. The adjusting male protrusions 637 are configured to be inserted into and engage an associated recess in a removable pillar (not shown), or the like. The removable pillar may have a cylindrical shape, a tubular shape, a bar shape, or the like. The removable pillar may be configured to be movably placed atop and engage any one of the plurality of adjusting male protrusions 637. The removable pillar may be configured to have a length that is substantially equal to the distance between the inner surfaces of the top wall 302 and bottom wall 202, so as to provide additional reinforcing strength to the bow case 100.

Each of the protrusions 270, 370 may be formed, for example, as a hollow tubular projection with a cavity, such as, e.g., cavities 272A, 372A, 372B, 372C (shown in FIG. 4) or the like, formed on the exterior surface of the lower or upper body portions 200, 300. As seen in FIG. 6, each protrusion 270 may include a surface pattern 274, such as, e.g., projections 274B and 274C and/or the like, at a tip end portion thereof. The protrusions 370 may also have a surface pattern (shown in FIG. 5), such as, e.g., a recess and/or the like at a tip end thereof. The surface pattern of the protrusion 370 may be configured to engage the surface pattern 274 of the corresponding protrusion 270 when the bow case 100 is closed, as seen in FIG. 5. The surface patterns 274 may contribute to connecting a pair of corresponding protrusions 270, 370 more securely in forming the pillar 170.

FIGS. 9A, 9B, 9C and 9D show the bow case 100 storing various crossbows 500A, 500B, 500C and 500D having different constructions. The bow case 100 may be configured large enough to accommodate various crossbows regardless of their types, constructions, sizes and the like. Thus, it may not be necessary for a user to acquire different cases for different bows.

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications, or modifications of the disclosure.

What is claimed is:

1. A bow case comprising:

a main body portion comprising: a lower body portion having a bottom wall and a sidewall surrounding the bottom wall; and an upper body portion pivotally connected to a front portion of the lower body portion to move between an open position and a closed position;

a tail portion connected to a rear portion of the main body portion and comprising:

a lower tail portion connected to the lower body portion; and an upper tail portion pivotally connected to a rear portion of the lower tail portion to move between the open position and the closed position; and a storage space substantially encapsulated by the main body portion and the tail portion when the upper body portion and the upper tail portion are in the closed position, wherein a length of the tail portion protruding from the main body portion is adjustable and the length of the lower tail portion further comprises a plurality of grooves and the lower body portion further comprises a protrusion pattern wherein the length of the tail portion is adjustable by configuring the protrusion pattern in the lower body portion to fit in and mate with the grooves of the lower tail.

2. The bow case of claim 1, wherein the lower body portion comprises a bottom wall and a sidewall extending from the bottom wall.

3. The bow case of claim 2, wherein the bottom wall has a stingray shape.

4. The bow case of claim 1, further comprising a well formed on at least one of the lower body portion and the upper body portion.

5. The bow case of claim 1, further comprising a pillar extending between the lower body portion and the upper body portion when the upper body portion is in the closed position.

6. The bow case of claim 5, wherein the pillar comprises:

a first protrusion extending upwardly from the lower body portion; and a second protrusion extending downwardly from the upper body portion.

7. The bow case of claim 6, wherein the pillar further comprises a surface pattern formed on a tip end of at least one of the first protrusion and the second protrusion.

8. The bow case of claim 1, further comprising a handle.

9. The bow case of claim 1, further comprising a stabilizing element.

10. The bow case of claim 1, further comprising a fastener.

11. The bow case of claim 1, wherein the length of the tail portion retracts into the main body portion by fitting and mating the protrusion pattern in the lower body portion with the groove closest to the rear end wall of the lower tail portion.

12. The bow case of claim 1, wherein the length of the tail portion is configured to retract into the main body portion to reduce storage space.

13. A bow case comprising:

a main body portion comprising:

a lower body portion having a bottom wall and a sidewall surrounding the bottom wall; and an upper body portion pivotally connected to a front portion of the lower body portion to move between an open position and a closed position;

a tail portion connected to a rear portion of the main body portion and comprising:

a lower tail portion connected to the lower body portion; and an upper tail portion pivotally connected to a rear portion of the lower tail portion to move between the open position and the closed position; and a storage space substantially encapsulated by the main body portion and the tail portion when the upper body portion and the upper tail portion are in the closed position, wherein the tail portion is configured to move with respect to the main body portion in order to adjust the length of the bow case to accommodate bows of different sizes and wherein the length of the lower tail portion further comprises a plurality of grooves and the lower body portion further comprises a protrusion pattern and wherein the length of the tail portion is adjustable by configuring the protrusion pattern in the lower body portion to fit in and mate with the grooves of the lower tail portion.

14. The bow case of claim 13, wherein the lower body portion comprises a bottom wall and a sidewall extending from the bottom wall.

15. The bow case of claim 14, wherein the bottom wall has a stingray shape.

16. The bow case of claim 13, further comprising a well formed on at least one of the lower body portion and the upper body portion.

17. The bow case of claim 13, further comprising a pillar extending between the lower body portion and the upper body portion when the upper body portion is in the closed position.

18. The bow case of claim 17, wherein the pillar comprises:

a first protrusion extending upwardly from the lower body portion; and a second protrusion extending downwardly from the upper body portion.

19. The bow case of claim 18, wherein the pillar further comprises a surface pattern formed on a tip end of at least one of the first protrusion and the second protrusion.

20. The bow case of claim 13, further comprising a handle.

21. The bow case of claim 13, further comprising a stabilizing element.

22. The bow case of claim 13, further comprising a fastener.

23. The bow case of claim 13, wherein the length of the tail portion retracts into the main body portion by fitting and mating the protrusion pattern in the lower body portion with the groove closest to the rear end wall of the lower tail portion.

* * * * *